US005570643A

United States Patent [19]

Werner

[11] Patent Number: 5,570,643

[45] Date of Patent: Nov. 5, 1996

[54] PULL SHEET PALLET WITH COLLAPSIBLE NUB STRUCTURES

[76] Inventor: Gary D. Werner, 70 S. Eaton Ct., Lakewood, Colo. 80226

[21] Appl. No.: 292,516

[22] Filed: Aug. 18, 1994

[51] Int. Cl.[6] ..... B65D 19/00

[52] U.S. Cl. ..... 108/51.1; 248/346.02

[58] Field of Search ..... 108/51.1, 55.1, 108/55.3; 248/346.02

[56] References Cited

U.S. PATENT DOCUMENTS

| | | | |
|---|---|---|---|
| Re. 29,192 | 4/1977 | Anderson et al. | 108/55.3 X |
| 1,953,303 | 4/1934 | Kohlmann | 108/55.3 X |
| 2,481,233 | 9/1949 | Morset | 108/55.3 X |
| 3,093,216 | 6/1963 | Dunham | 108/51.1 X |
| 3,690,485 | 9/1972 | Fischer et al. | 108/51.1 X |
| 3,710,733 | 1/1973 | Story | 108/51.1 |
| 4,507,348 | 3/1985 | Nagata et al. | 108/51.1 X |
| 4,774,892 | 10/1988 | Ballard et al. | 108/55.3 |
| 5,062,370 | 11/1991 | Etlinger | 108/51.1 X |
| 5,226,372 | 7/1993 | Frenkel et al. | 108/51.1 |

*Primary Examiner*—José V. Chen

*Attorney, Agent, or Firm*—Timothy J. Martin; Michael R. Henson

[57] ABSTRACT

A pull sheet pallet is provided and is adapted to be placed on a flat support surface for loading cargo thereon so that the cargo can be moved. The pallet comprises a sheet of material which is formed to have a plurality of nub structures thereon so that a plurality of protrusions extend upwardly from an upper surface of the material and a plurality of concavities are formed into a lower surface of the material. The sheet pallet is constructed of a stiff yet pliable material such that, when cargo is loaded onto the upper surface, contacted ones of the nub structures operate to collapse thereby forming a plurality of course regions on the upper surface which inhibit lateral sliding movement of the cargo on and across the upper surface when the cargo is acted upon by a force. Uncontacted ones of the nub structures form a raised barrier which operates to resist lateral movement of the sliding cargo. A lip may be disposed along a peripheral edge of the sheet of material.

15 Claims, 3 Drawing Sheets

PULL SHEET PALLET WITH COLLAPSIBLE NUB STRUCTURES

FIELD OF THE INVENTION

The present invention relates to pallets on which cargo is loaded so that the cargo can be moved. More particularly, the present invention is directed to a pull sheet pallet that is adapted to be placed on a flat support surface for leading cargo thereon so that cargo can be moved. With a plurality of collapsible nub structures projecting from an upper surface, the pull sheet pallet of the present invention is particularly suitable to inhibit cargo from sliding on and across the upper surface of the pull sheet pallet when acted upon by a force while being moved.

BACKGROUND OF THE INVENTION

Today's thriving economy is predicated in part upon a manufacturer's ability to deliver its products to the end users. To achieve this goal, often manufacturers ship large quantities of packaged products to wholesalers and distributors which, in turn, ship smaller quantities of packaged products to retailers and dealers. To commence the shipping process, the packaged products are stored in a manufacturer's warehouse and are loaded onto pallets and moved into trailer trucks.

Conventional pallets have long been the workhorses of the shipping industry. These pallets are fabricated from a variety of materials and, for many decades, have effectively moved large quantities of products from one location to another. Wood is a common material used to construct pallets. Unfortunately, depending upon the use and abuse that the pallet undergoes when shipping products, the wooden pallet typically has a limited useful life, sometimes as short as a single haul. Even worse, a careless lift operator can break a pallet even before its first haul. Furthermore, over the past few years, the cost of wood has become rather expensive thereby causing the transportation industry to seek alternative, less-costly materials for fabricating pallets. Various types of plastics as well as metal have been used to fabricate pallets. Although both of these materials have been viable for use, these pallets also yield a limited useful life due to the use and abuse that the pallets undergo during the shipping process.

Additionally, wooden, plastic and metal pallets are bulky. When not in use, these pallets occupy substantial storage space. Also, it is necessary that a shipping warehouse maintain a large number of these pallets in stock at all times. Otherwise, shipments of products cannot be made. In some instances, pallets must be returned to the shipping warehouse in order to maintain the appropriate number in stock.

Due to cost, breakage, storage, inventory and limited useful life of conventional pallets, the transportation industry responded to these concerns by the introduction of a pull sheet pallet. In general, a pull sheet pallet is a sheet of material such as polypropylene and high density polyethylene. Both of the materials have a high tensile strength. The pull sheet pallet is placed upon a floor of a warehouse or truck so that cargo can be loaded on it. The pull sheet pallet has a lip which projects outwardly and upwardly in order that a gripper bar of a motorized lift vehicle can grasp the lip of the pull sheet and pull the pull sheet pallet onto a platen of the lift vehicle. A segment of the transportation industry considers the pull sheet pallet to be a low cost and effective substitute for conventional pallets for several reasons. First, pull sheets are inexpensive. In fact, the industry considers them to be discardable for recycling after its first use. Second, pull sheet pallets are millimeters thick as opposed to conventional pallets which are inches thick. Thus, pull sheet pallets are lightweight and compact for storage. Third, although pull sheet pallets occasionally tear when being pulled, pull sheet pallets are far more durable than conventional pallets.

One type of a pull sheet pallet is disclosed in U.S. Pat. No. 5,226,372 to Frenkel et al. This pull sheet pallet has a plurality of nibs projecting from a lower surface thereof and a plurality of corresponding recesses formed into an upper surface thereof. The pull sheet pallet is fabricated of a plastic material such as polypropylene and high density polyethylene having a thickness of between 0.040 inches and 0.125 inches. This plastic material is stiff yet resilient so that when cargo is placed on the upper surface of the pallet and thereafter transported, shock which is continually being induced can be absorbed by minute contractions and subsequent expansions of the nibs. The pull sheet pallet also includes a lip which can be grasped by the griper bar of the motorized lift vehicle so that the loaded pull sheet pallet can be pulled onto the platen or held for sliding the platen thereunder. Further, the nibs support the load of the cargo above a support surface in a manner whereby only apex portions of the nibs contact the support surface. This feature not only allows contraction and expansion of the nibs but also reduces the amount of force necessary to overcome friction when the pull sheet pallet pulled onto and pushed off of the platen.

However, there is a drawback associated with employing prior art pull sheet pallets such as the one disclosed in the above-cited patent. Pull sheet pallets are fabricated from various types of plastic sheet material which generally have smooth surfaces. Since a smooth upper surface contacts the cargo when loaded thereon, the cargo tends to slide off of the pull sheet pallet when acted on by a force.

In an effort to resolve this problem with cargo sliding off of the pull sheet pallet, one manufacturer has fabricated a laminated pull sheet whereby a second sheet of plastic having a higher coefficient of surface friction is laminated as an upper sheet onto the base sheet. The cargo is loaded onto the upper sheet. Although effective in reducing the amount of sliding that the cargo undergoes when acted upon by a force, the lamination contributes to increased material costs as well as increased manufacturing costs.

There is a need in the transportation industry to provide a low-cost pull sheet pallet which inhibits cargo from sliding when acted on by a force. There is also a need in the industry to provide a low-cost pull sheet that can either be discarded after the first use or reused depending on the desires of the shipper. It would be beneficial if the pull sheet pallet had a single ply construction and was simple to manufacture. The present invention addresses these needs and provides these benefits.

SUMMARY OF INVENTION

It is an object of the present invention to provide a new and improved pull sheet pallet with collapsible nub structures that inhibits lateral sliding movement of cargo loaded thereon when the cargo is acted upon by a force.

Yet another object of the present invention is to provide a pull sheet pallet with collapsible nub structures that can form a plurality of collapsed regions on its upper surface when the cargo is loaded onto the pull sheet pallet.

A still further object of the present invention is to provide a pull sheet pallet with nub structures so that uncontacted ones of the nub structure form a raised barrier alongside at least a portion of the cargo.

It is a further object of the present invention is to provide a pull sheet pallet with collapsible nub structures which is lightweight and inexpensive to manufacture.

Yet another object of the present invention is to provide a pull sheet pallet that can be re-used, recycled or discarded depending upon the desires of the user.

It is yet a further object of the present invention to provide a pull sheet pallet with collapsible nub structures employing a plastic material of a single ply construction.

Accordingly, a pull sheet pallet is hereinafter described. The pull sheet pallet is adapted to be placed on a flat support surface for loading cargo thereon so that the cargo can be moved. The pull sheet pallet includes a sheet of material having an upper surface and an opposite lower surface with a thickness therebetween and having an outer peripheral edge. The sheet of material includes a plurality of nub structures formed thereon so that a plurality of protrusions extend upwardly from the upper surface and a plurality of concavities are formed into the lower surface to correspond with the plurality of protrusions. The sheet of material is constructed of a stiff yet pliable material. When the cargo is loaded onto the upper surface of the sheet of material, contacted ones of the nub structures are operative to at least partially collapse thereby forming a plurality of collapsed regions on the upper surface. The plurality of collapsed regions on the upper surface inhibit lateral sliding movement of the cargo on and across the upper surface when the cargo is acted upon by a force while being moved. Also, when cargo is loaded onto the upper surface of the sheet of material, uncontacted ones of the nub structures form a raised barrier alongside at least a portion of the cargo. The barrier is operative to resist lateral movement of sliding cargo when the uncontacted ones of the nub structures are subsequently contacted by sliding cargo.

A lip is connected to at least a portion of the peripheral edge of the sheet of material and extends upwardly and outwardly at an obtuse angle relative to the sheet of material. It is preferred that the lip is fabricated from a stiff yet pliable material. It is also preferred that the lip and the sheet of material is a one-piece unitary construction.

The stiff yet pliable material is selected from a group consisting of plastic and paper. The plastic material is selected from a group of plastic consisting of polypropylene and high density polyethylene. Preferably, the stiff yet pliable material has a tensile strength in a range of 3,100 pounds per square inch to 6,000 pounds per square inch and has a thickness in a range of 0,016 inches to 0.033 inches. It is further preferred that the sheet of material is configured in a shape of a rectangle and that the nub structures are configured in a shape selected from a group consisting of a bell, dome, a cone, an elongated rib, a box and a frustum.

These and other objects of the present invention will become more readily appreciated and understood from a consideration of the following detailed description of the exemplary embodiment of the present invention when taken together with the accompanying drawings, in which:

DETAILED DESCRIPTION OF THE EXEMPLARY EMBODIMENT

A pull sheet pallet of the present invention is adapted to be placed on a flat surface for loading cargo thereon so that the cargo can be moved. The pull sheet pallet of the present invention includes a plurality of collapsible nub structures which extend upwardly from an upper surface of the pull sheet pallet. When cargo is loaded onto the upper surface of the pull sheet pallet, contacted ones of the nub structures are operative to at least partially collapse to form a plurality of collapsed regions on the upper surface which inhibits lateral sliding movement of the cargo. Uncontacted ones of the nub structures form a barrier alongside at least a portion of the cargo so that the raised barrier resists lateral movement of sliding cargo when subsequently contacted.

Figure 1:
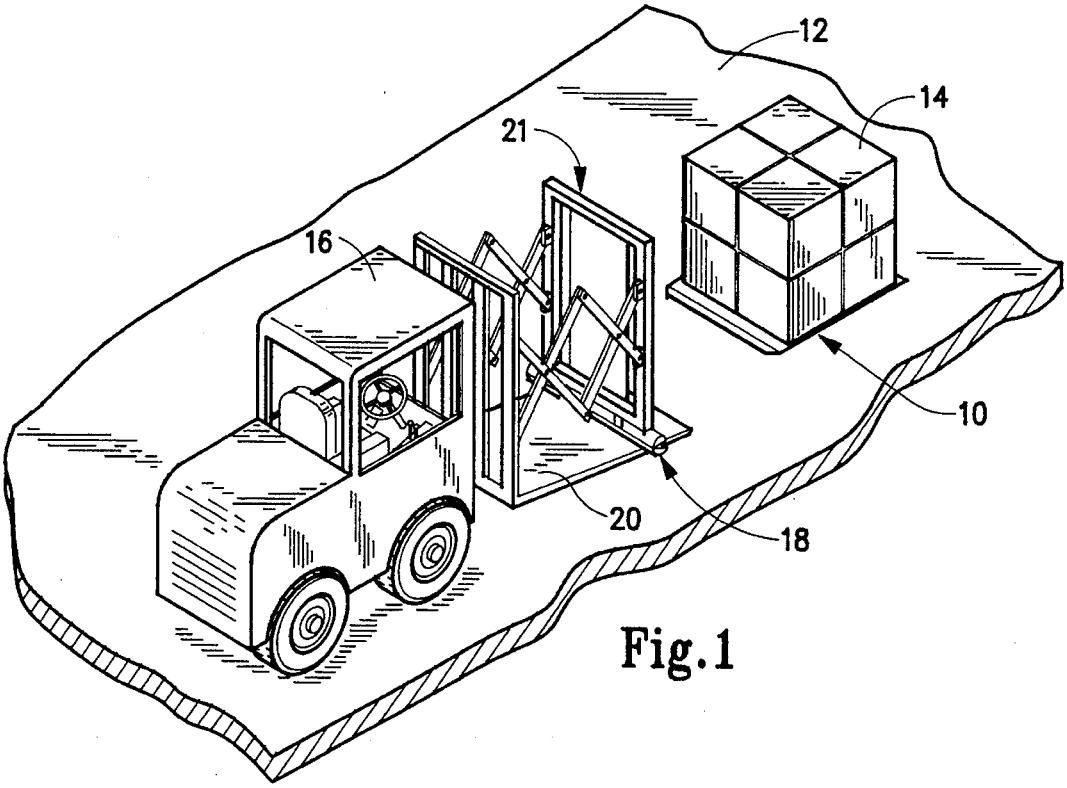
FIG. 1 is a perspective view of a pull sheet pallet of the present invention placed on a flat support surface with cargo loaded thereon and showing a motorized lift vehicle approaching the loaded pull sheet pallet so that it can be placed onto a platen and moved.
Figure 2:
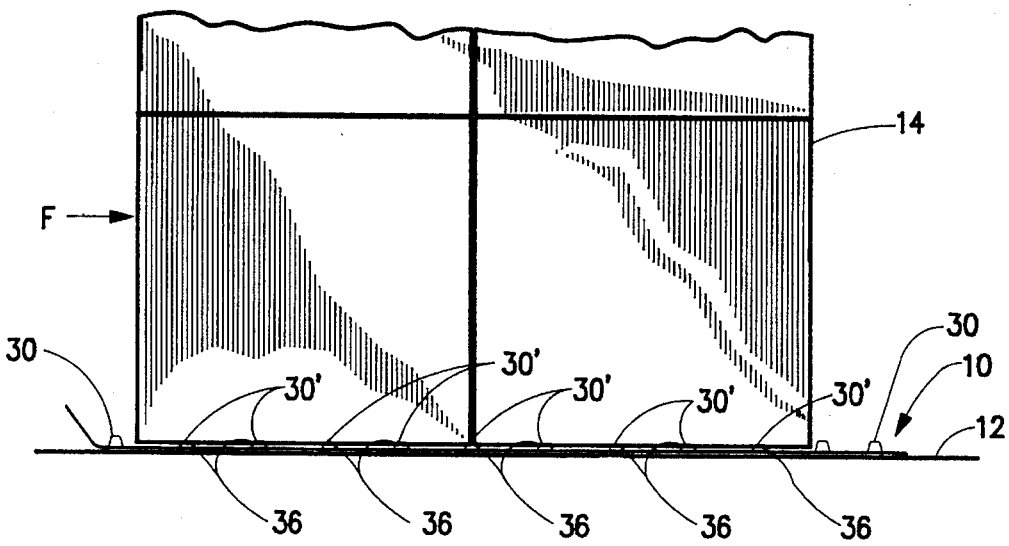
FIG. 2 is a side view in elevation of the pull sheet pallet of the present invention with cargo loaded thereon.

A pull sheet pallet 10 of the present invention is generally introduced in FIGS. 1–10. As best shown in FIGS. 1 and 2, pull sheet pallet 10 is adapted to be placed on a flat support surface 12 for loading cargo 14 thereon so that cargo 14 can be moved. As shown in FIG. 1, cargo 14 is moved by a motorized lift vehicle 16 having a gripper bar assembly 18 and a platen 20. Gripper bar assembly 18 is operative to grip pull sheet pallet 10 loaded with cargo 14 so that loaded pull sheet pallet 10 can be either pulled onto platen 20 by pantagraph 21 or platen 20 can be pushed underneath loaded pull sheet pallet 10.

Figure 3:
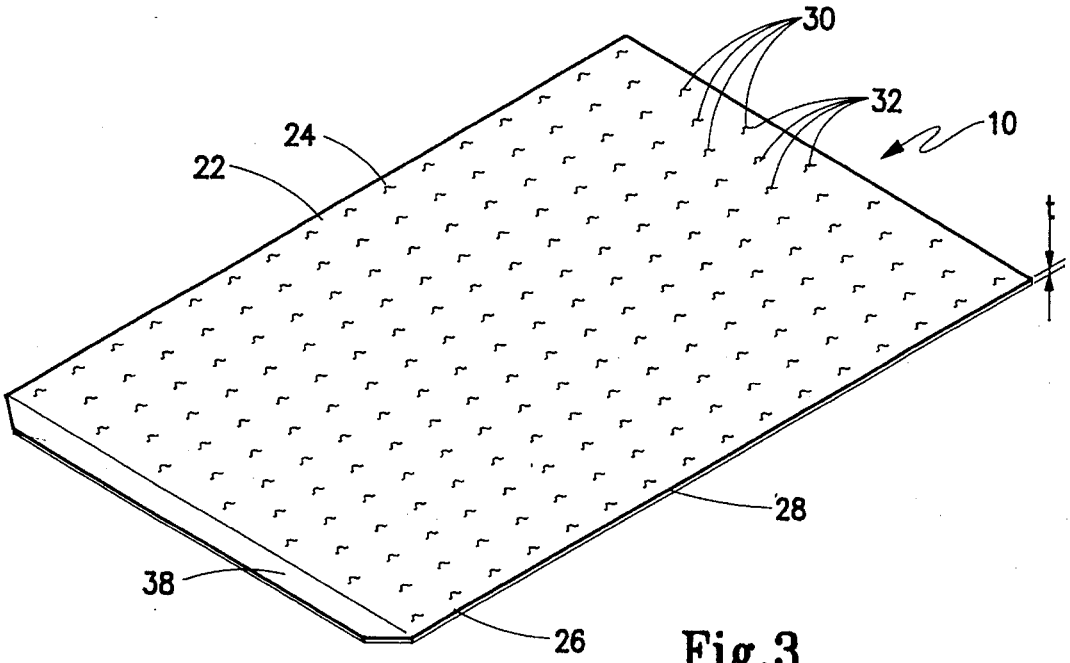
FIG. 3 is a perspective view of the pull sheet pallet of the present invention shown in FIG. 1 with a plurality of hub structures formed thereon.

As best shown in FIG. 3, pull sheet pallet 10 includes a sheet of material 22 having an upper surface 24 and an opposite lower surface 26 with a thickness "t" therebetween and having an outer peripheral edge 28. Sheet of material 22 includes a plurality of nub structures 30 formed thereon so that a plurality of protrusions 32 extend upwardly from upper surface 24 and a plurality of concavities 34 are formed into lower surface 26 to correspond with the plurality of protrusions 32.

Figure 4:
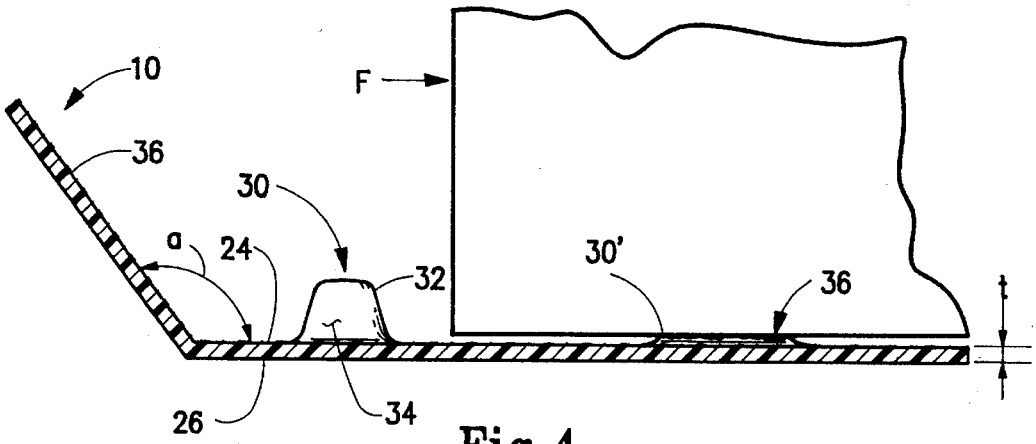
FIG. 4 is a partial side view in elevation of the pull sheet pallet shown in FIG. 2 with an uncontacted nub structure forming a raised barrier and having a bell shape and a contacted nub structure collapsed to form a collapsed region.

As best shown in FIGS. 2 and 4, when cargo 14 is loaded onto upper surface 24 of sheet of material 22, contacted ones of nub structures 30' are operative to at least partially collapse thereby forming a plurality of collapsed regions 36 on upper surface 24 which inhibit lateral sliding movement of cargo 14 on and across upper surface 24 when cargo 14 is acted upon by a force "F" while being moved. One of ordinary skill in the art would appreciate that force "F" can be induced in a variety of ways such as by pushing the cargo, tilting the cargo and subjecting the cargo to angular movement while being moved. Additionally, when cargo 14 is loaded onto upper surface 24 of sheet of material 22, uncontacted ones of nub structures 30 form a raised barrier alongside at least a portion of cargo 14. The barrier is operative to resist lateral movement of sliding cargo 14 when the uncontacted ones of nub structures 30 are subsequently contacted by sliding cargo 14.

With references to FIGS. 3 and 4, pull sheet pallet 10 includes a lip 38 which is connected to a portion of peripheral edge 28 of sheet of material 22. Lip 38 extends upwardly and outwardly at an obtuse angle "a" relative to sheet of material 22. Lip 38 facilitates gripping of pull sheet pallet 10 by gripper bar 18.

Both sheet of material 22 and lip 38 are fabricated from a stiff yet pliable material. It is preferred that lip 38 and sheet of material 22 are a one-piece unitary construction. The stiff yet pliable material is selected from a group consisting of plastic, paper and a composite material of paper and plastic. The plastic is selected from a group of plastic consisting of polypropylene and high density polyethylene. It is preferred that the stiff yet pliable material has a tensile strength of 3,100 pounds per square inch to 6,000 pounds per square inch. Thickness "t" of sheet of material 22 is in a range of 0.016 inches to 0,033 inches. With sheet of material 22 and lip 38 being of a one-piece unitary construction, lip 38 would also have the physical characteristics of sheet of material 22 as described above.

Figure 5:
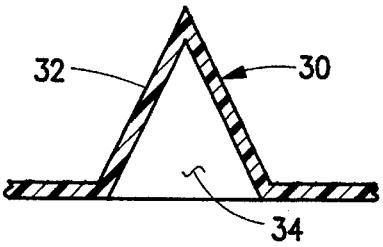
FIG. 5 is a partial side view in cross-section of a second alternative nub structure configured in a shape of a cone.
Figure 6:
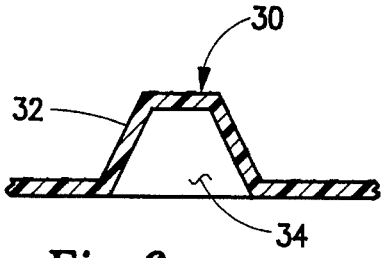
FIG. 6 is a partial side view in elevation of the a third alternative nub structure configured in a shape of a frustum.
Figure 7:
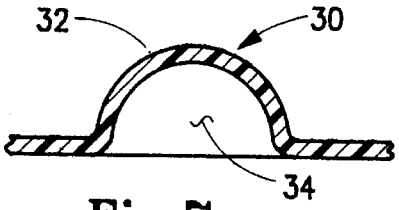
FIG. 7 is a partial side view in elevation of a fourth alternative nub structure configured in a shape of a dome.
Figure 9:
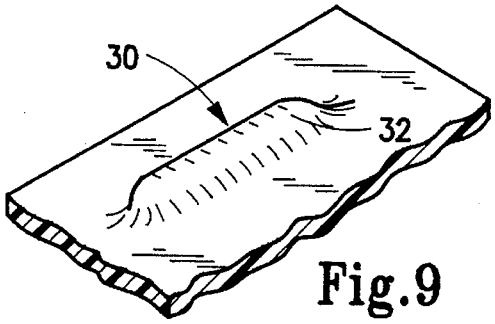
FIG. 9 is a partial perspective view of a sixth alternative nub structure configured in a shape of an elongated rib.
Figure 8:
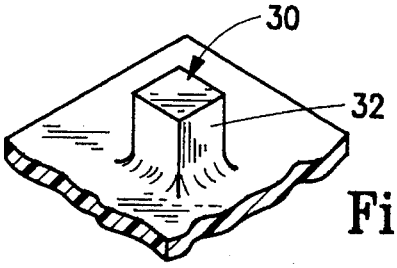
FIG. 8 is a partial perspective view of a fifth alternative nub structure configured in a shape of a box.

Although not by way of limitation, sheet of material 22 is configured in a shaped of a rectangle as best shown in FIG. 3. It is preferred that nub structures 30 are configured in a shape of a bell as shown in FIG. 4. Nub structures 30 can be formed into a variety of shapes. Several alternative shapes are shown in FIGS. 5–9 by way of example only. FIG. 5 shows nub structure 30 in a shape of a cone. FIG. 6 shows nub structure 30 in a shape of a frustum. FIG. 7 shows nub structure 30 in a shape of dome. FIG. 8 shows nub structure 30 in a shaped of a box. FIG. 9 shows nub structure 30 in a shape of an elongated rib.

Figure 10:
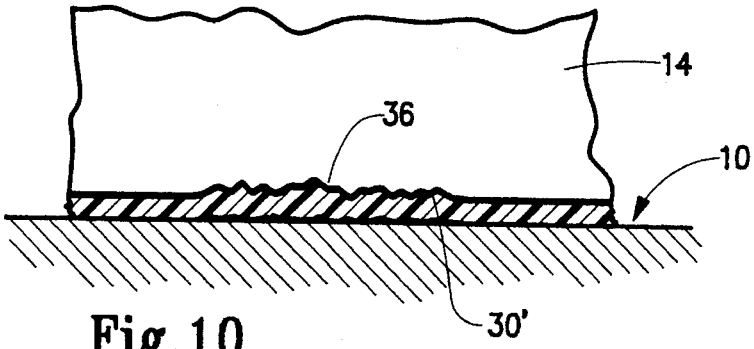
FIG. 10 is a partial side view in elevation of a nub structure collapsed within a corresponding concavity under cargo encased in a malleable container that conforms to the configuration of the collapsed region.
Figure 11:
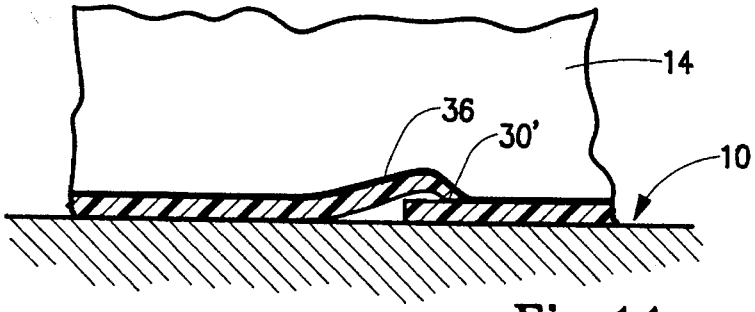
FIG. 11 is a partial side view in elevation of a nub structure collapsed partially within and partially outside of a corresponding concavity under cargo encased in a malleable container that conforms to the configuration of the collapsed region.
Figure 12:
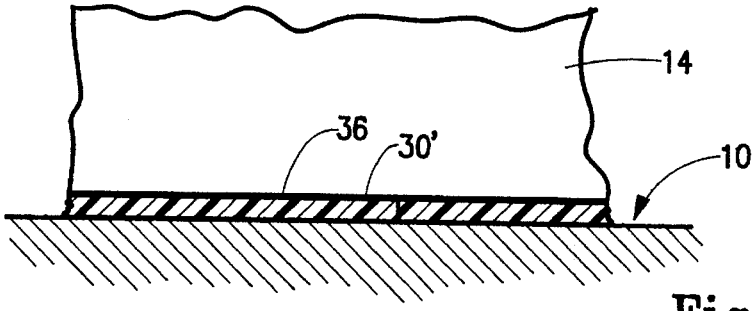
FIG. 12 is a partial side view in elevation of a nub structure collapsed within a corresponding concavity under cargo encased in a rigid container.

FIGS. 10–12 illustrate how nub structures 30 operate after being collapsed. In FIG. 10, a contacted one of nub structure 30' is collapsed by cargo 14 to form collapsed region 36. Sometimes cargo 14 is encased in a container fabricated from a malleable material such as cardboard. As shown in FIG. 10, the malleable container tends to conform to the configuration of collapsed region 36 thereby inhibiting sliding movement of cargo 14. A collapsed region 36, as shown in FIG. 11, can be formed when cargo 14 slides across a previously uncontacted nub structure to produce a collapsed nub structure 30'. Again, cargo 14 encased by a container fabricated of a malleable material conforms to the configuration of collapsed region 36. In FIG. 12, cargo having a container fabricated of a rigid material such as steel contacts collapsed region 36. In brief, no matter how nub structure 30 collapses and regardless of whether cargo is encased in a malleable or a rigid container, pull sheet pallet 10 of the present invention continues to inhibit lateral sliding movement of cargo 14 when acted on by a force as a result of the course regions that are formed when the nub structures collapse.

A skilled artisan would appreciate the numerous advantages and features of the pull sheet pallet of the present invention. The pull sheet pallet of the present invention with collapsible nub structures inhibit lateral sliding movement of cargo loaded thereon when acted upon by a force. Also, regardless if the pull sheet pallet of the present invention has been previously used, the pull sheet pallet of the present invention can be reused because the collapsed nub structure continue to inhibit lateral sliding movement of the cargo as a result of the coarse regions formed into the upper surface. Alternatively, the pull sheet pallet of the present invention can be either discarded or recycled. Also, when loaded, uncontacted ones of the nub structures form a raised barrier alongside at least a portion of the cargo further inhibiting sliding movement of the cargo thereon. The pull sheet pallet of the present invention is insensitive as to whether cargo encased in a container that is fabricated of a rigid or a malleable material and is insensitive to the configuration of the nub structures themselves.

Accordingly, the present invention has been described with some degree of particularity directed to the exemplary embodiment of the present invention. It should be appreciated, though, that the present invention is defined by the following claims construed in light of the prior art so that modifications or changes may be made to the exemplary embodiment of the present invention without departing from the inventive concepts contained herein.

I claim:

1. A pull sheet pallet adapted to be placed on a flat support surface for loading cargo thereon so that the cargo can be moved, comprising:

(a) a sheet of material having an upper surface and an opposite lower surface with a thickness therebetween and having an outer peripheral edge, said sheet including a plurality of nub structures formed thereon so that a plurality of protrusions extend upwardly from said upper surface and a plurality of concavities are formed into said lower surface to correspond with said plurality of protrusions, said sheet constructed of a stiff yet pliable material such that, when cargo is loaded onto said upper surface of said sheet, contacted ones of said nub structures are operative to collapse thereby forming a plurality of collapsed regions on said upper surface which inhibit lateral sliding movement of the cargo on and across said upper surface when the cargo is acted upon by a force; and (b) a lip connected to at least a portion of said peripheral edge of said sheet of material and extending upwardly and outwardly at an obtuse angle relative to said sheet of material.

2. A pull sheet pallet according to claim 1 wherein, when cargo is loaded onto said upper surface of said sheet, uncontacted ones of said nub structures form a raised barrier operative to resist lateral movement of sliding cargo when said uncontacted ones of said nub structures are subsequently contacted by sliding cargo.

3. A pull sheet pallet according to claim 1 wherein said lip is fabricated from a stiff yet pliable material.

4. A pull sheet pallet according to claim 1 wherein said lip and said sheet of material is a one-piece unitary construction.

5. A pull sheet pallet according to claim 1 wherein said stiff yet pliable material is selected from a group consisting of plastic, paper and a composite material of paper and plastic.

6. A pull sheet pallet according to claim 5 wherein said plastic is selected from a group of plastic consisting of polypropylene and high density polyethylene.

7. A pull sheet pallet according to claim 5 wherein said stiff yet pliable material has a tensile strength in a range of 3,100 pounds per square inch and 6,000 pounds per square inch.

8. A pull sheet pallet according to claim 1 wherein said thickness of said sheet of material is in a range of 0.016 inches and 0.033 inches.

9. A pull sheet pallet according to claim 1 wherein said sheet of material is configured in a shape of a rectangle.

10. A pull sheet pallet according to claim 1 wherein said nub structures are configured in a shape selected from a group consisting of a bell, a dome, a cone, an elongated rib, a box and a frustum.

11. A pull sheet pallet adapted to be placed on a flat support surface for loading cargo thereon so that the cargo can be moved, comprising:

(a) a sheet of material having an upper surface and an opposite lower surface with a thickness therebetween and having an outer peripheral edge, said sheet including a plurality of nub structures formed thereon so that a plurality of protrusions extend upwardly from said upper surface and a plurality of concavities are formed into said lower surface to correspond with said plurality of protrusions, said sheet constructed of a stiff yet pliable material such that, when cargo is loaded onto said upper surface of said sheet, uncontacted ones of said nub structures form a raised barrier operative to resist lateral movement of sliding cargo when contacted thereby; and (b) a lip disposed along at least a portion of said peripheral edge of said sheet of material, said lip extending outwardly and outwardly at an obtuse angle relative to said sheet of material.

12. A pull sheet pallet according to claim 11 wherein said sheet of material and said lip are a one-piece unitary construction.

13. A pull sheet pallet according to claim 11 wherein said stiff yet pliable material is selected from a group consisting of polypropylene and high density polyethylene, each one of said groups having a tensile strength in a range of 3,100 pounds per square inch and 6,000 pounds per square inch and having said thickness of said sheet of material in a range of 0.016 inches and 0.033 inches.

14. A pull sheet pallet adapted to be placed on a flat support surface for loading cargo thereon so that the cargo can be moved, comprising:

(a) a sheet of material having an upper surface and an opposite lower surface with a thickness therebetween and having an outer peripheral edge, said sheet including a plurality of nub structures formed thereon so that a plurality of protrusions extend upwardly from said upper surface and a plurality of concavities are formed into said lower surface to correspond with said plurality of protrusions, said sheet constructed of a stiff yet pliable material; and (b) a lip disposed along at least a portion of said peripheral edge of said sheet of material, said lip extending upwardly and outwardly at an obtuse angle relative to said sheet of material.

15. A pull sheet pallet according to claim 14 wherein when cargo is loaded onto said upper surface of said sheet, contacted ones of said nub structures are operative to collapse thereby forming a plurality of collapsed regions on said upper surface which inhibit lateral sliding movement of the cargo on and across said upper surface when the cargo is acted upon by a force while being moved and uncontacted ones of said nub structures form a raised barrier operative to resist lateral movement of sliding cargo when contacted thereby.

* * * * *